US005867849A

United States Patent [19]

Pontrello

[11] Patent Number: 5,867,849

[45] Date of Patent: Feb. 9, 1999

[54] TRANSFORMABLE LIVING SYSTEM

[76] Inventor: Dominica N. Pontrello, 144 W. 19th St., New York, N.Y. 10011

[21] Appl. No.: 627,255

[22] Filed: Apr. 3, 1996

[51] Int. Cl.[6] ..... A47C 17/34

[52] U.S. Cl. ..... 5/2.1; 5/722

[58] Field of Search ..... 5/2.1, 3, 5, 722, 5/723

[56] References Cited

U.S. PATENT DOCUMENTS

| | | | |
|---|---|---|---|
| 1,785,252 | 12/1930 | Frank | 5/722 |
| 2,528,768 | 11/1950 | Marsh | 5/723 X |
| 3,890,658 | 6/1975 | Petersilie | 5/722 X |
| 4,293,965 | 10/1981 | Hrubec | 5/722 X |

FOREIGN PATENT DOCUMENTS

| | | | |
|---|---|---|---|
| 2582493 | 12/1986 | France | 5/5 |
| 2009594 | 6/1979 | United Kingdom | 5/722 |

*Primary Examiner*—Michael F. Trettel
*Attorney, Agent, or Firm*—Weil, Gotshal & Manges LLP

[57] ABSTRACT

A set of living system units provides means for saving and utilizing space to users thereof. In an unstacked mode, the units function as seating and table articles for use in a user's living space. The units coordinate together in their unstacked mode to provide either a single bed or a double bed of standard sizes.

12 Claims, 6 Drawing Sheets

FIG. 4A
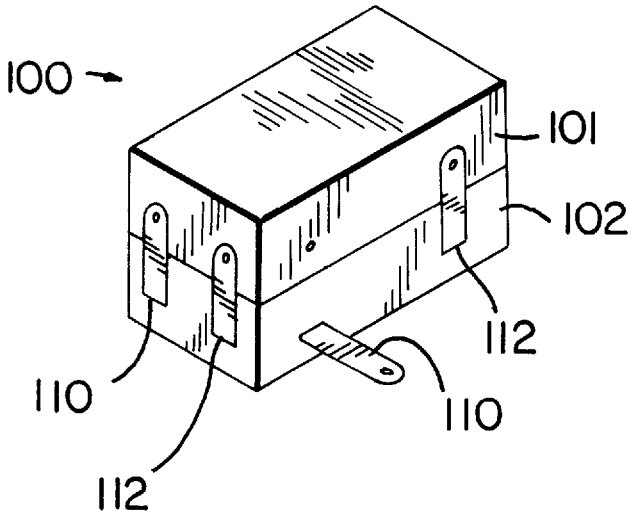
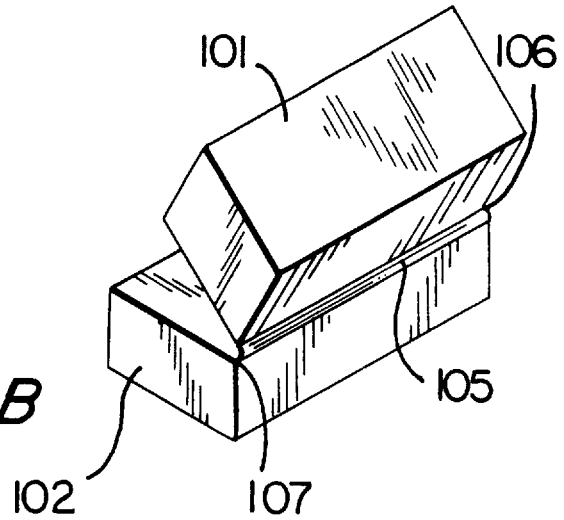
FIG. 4B

TRANSFORMABLE LIVING SYSTEM

BACKGROUND OF THE INVENTION

The present invention concerns a transformable living system that allows users thereof to sleep, work and live in the same space using a set of basic living system units. In an urban living setting, the availability of usable, personal space is severely limited. For example, in New York City, without access to substantial resources, one's living space will be excessively crammed if a bed, sofa, chair and an end table, each having only its traditional and ordinary functions, are used in the arrangement of the living space.

There are various prior art articles that are designed to save space for users thereof. For example, there is the sleeping sofa, which functions ordinarily as a sofa, but which can function as a bed when it is unfolded. There is also a chair that can be used as a narrow mattress when unfolded. However, each of these prior art articles functions independently of other household items to provide space savings.

Accordingly, it is an object of the present invention to provide a set of basic living system units that can be coordinated together to function as a household item and save living space for users thereof. A set of basic living system units would include a couch, chair, table and an end table. These four units in their ordinary functions provide substantially a living room set for their users. However, when the love seat and the chair are unstacked and rearranged, they are of equal height, and together provide a standard-size single bed. When the love seat, the chair, the table and the end table are unstacked and rearranged, all four are of equal height, and together provide a standard size double bed.

SUMMARY OF THE INVENTION

There is provided a set of living system units consisting of a first unit and a second unit, each of which operates in a stacked mode and an unstacked mode and has an interior and exterior surface. In the stacked mode, each unit functions as a seating unit and in the unstacked mode, the units are attached and together provide a standard-sized single bed. In another embodiment, the set consists of the two seating units, as well as two table units. When unstacked and rearranged, the four units together form a standard-size double bed.

BRIEF DESCRIPTION THE DRAWINGS

FIGS. 4A and 4B illustrate units equipped with connecting members.

DESCRIPTION OF THE PREFERRED EMBODIMENT

Figure 1:
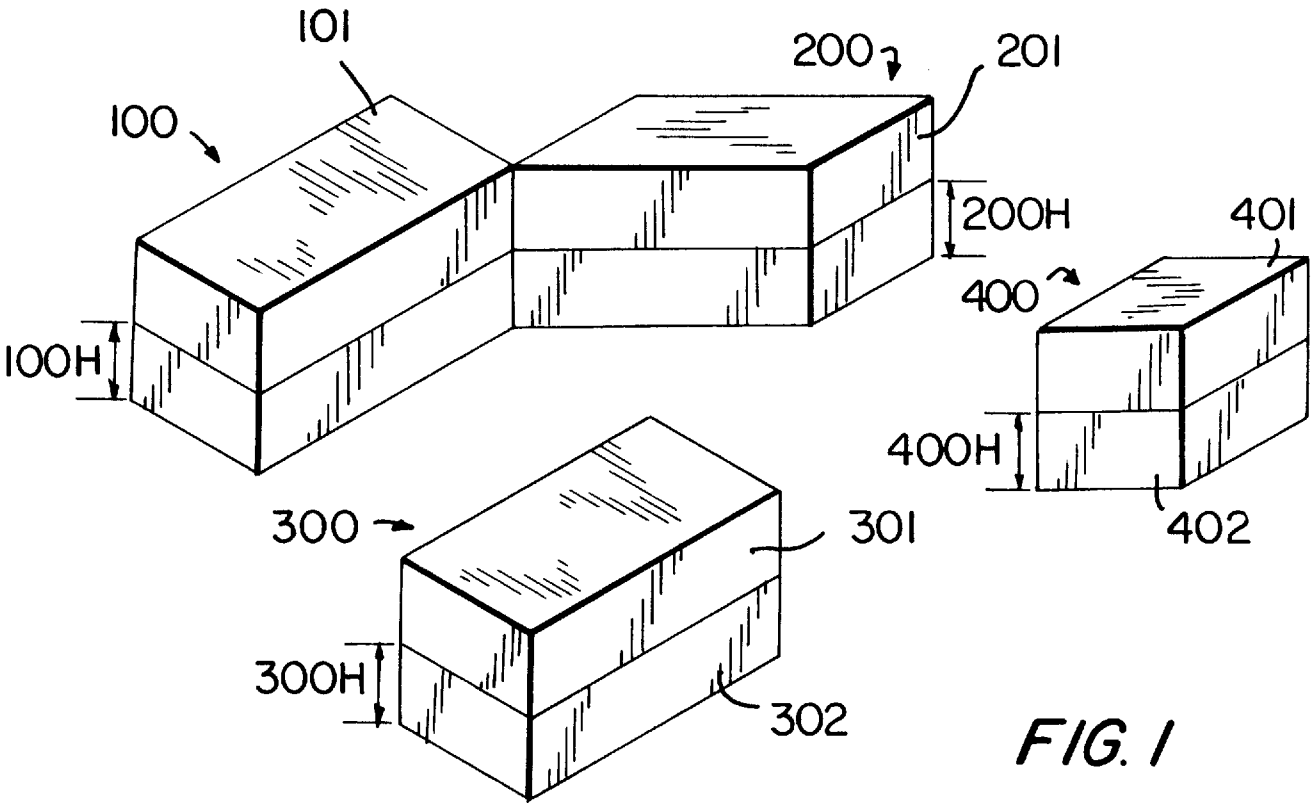
FIG. 1 illustrates a set of basic living system units.

The invention includes four living system units 100, 200, 300 and 400, as shown in FIG. 1. Each unit is composed of two identical rectangular pieces, preferably made of high-density foam protected by a suitable covering, such as cloth or leather, stacked upon each other: 101 and 102, 201 and 202, 301 and 302, and 401 and 402. A set may include the four units, a couch 100, a chair 200, a table 300 and an end table 400. The length and width dimensions of each stackable piece of these units are, respectively, 39×25 inches, 19.5×25 inches, 12.5×25 inches and 12.5×12 inches. The height 100H, 200H, 300H and 400H, of each stackable piece of the basic living space units is equal, i.e., 5.5 inches in the units shown in the drawing figures. When unstacked and repositioned, the couch 100 and chair 200 form a single bed, and the unstacked pieces forming the table and end table can be added to form a double bed, as described below. Further, each of the basic units has its own functionality independent of others in its folded mode, i.e., couch, chair, table, or end table. It is noted that a set may include only two of the basic living system units, i.e, the couch and chair.

Figure 2:
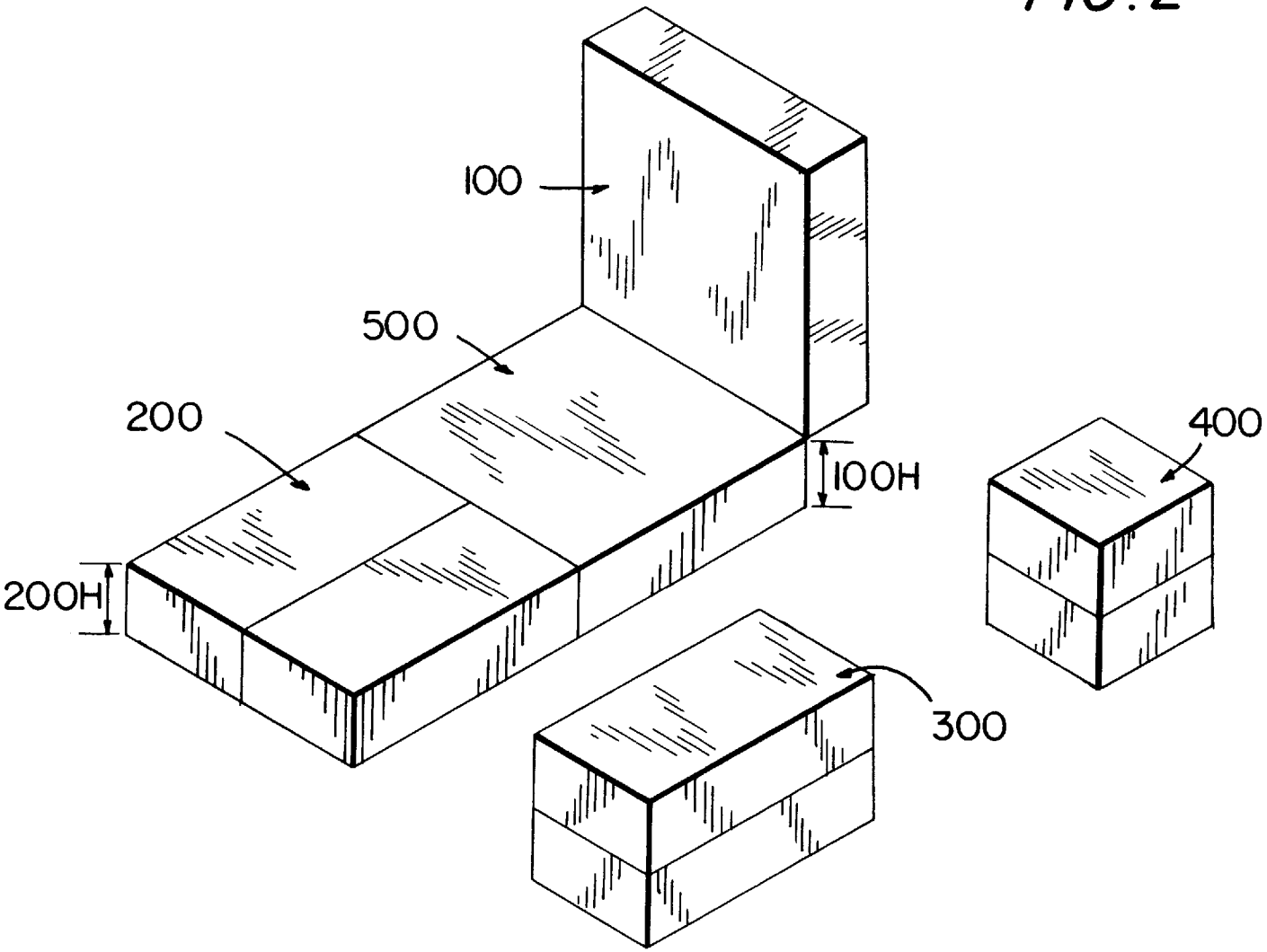
FIG. 2 illustrates a set of basic living system units where two of the units are unfold to provide a standard-sized single bed.

FIG. 2 illustrates that the dimensions of the couch 100 and the chair 200 of the basic units coordinate together to provide a single bed 500 when they are unstacked and arranged as shown. Each of the other basic units 300 and 400 is shown in its stacked mode functioning either as a table or an end table. Since the heights 100H and 200H of the unfolded units 100 and 200 are equal, a flat surface is provided to the users of the single bed thus assembled. The single bed 500 is of the standard size, thereby allowing use of standard single bed items, such as sheets and covers.

Figure 3:
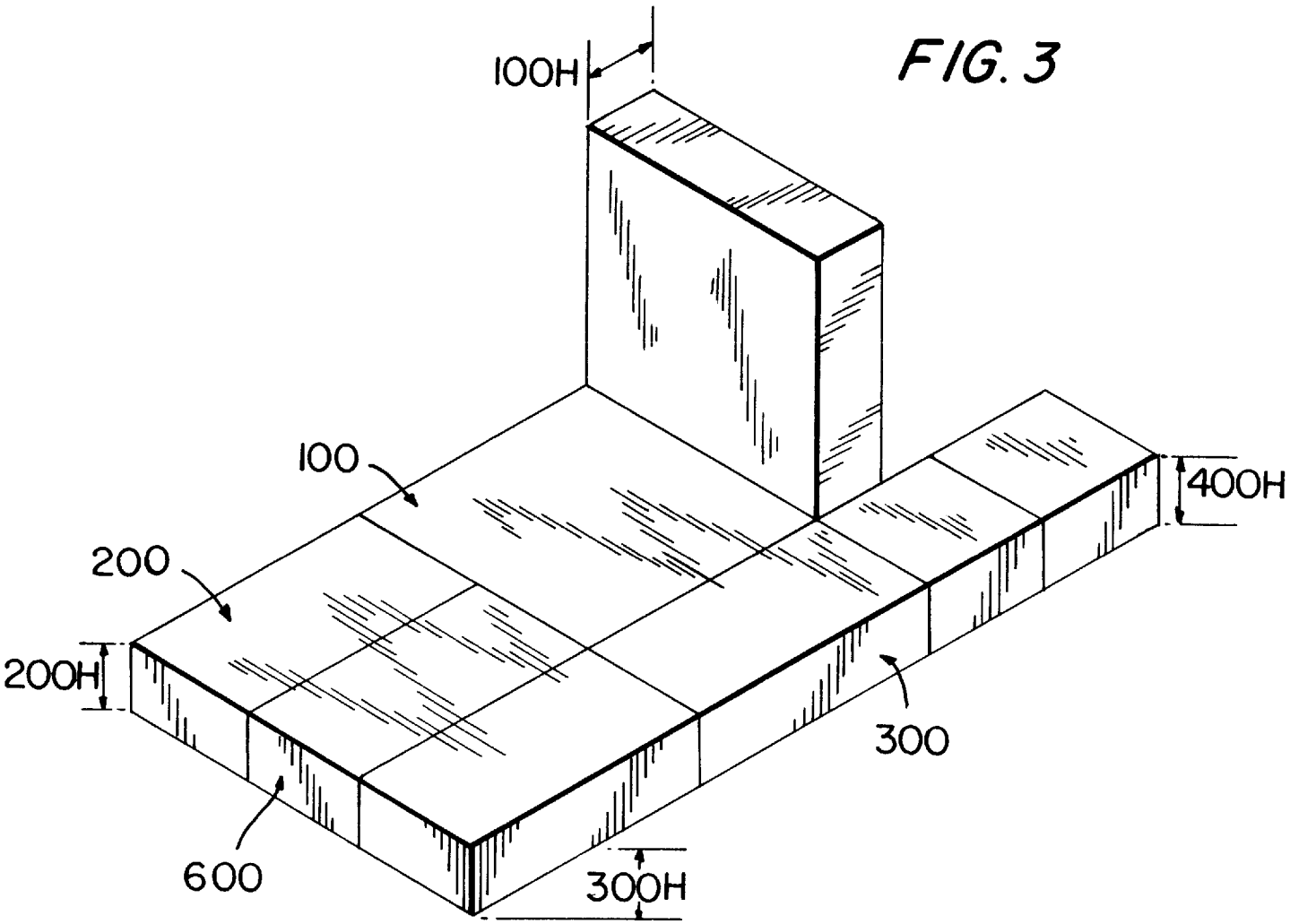
FIG. 3 illustrates a set of basic living system units where all four of the units are unfolded to provide together a double bed of the standard size.

FIG. 3 illustrates that the couch 100, the chair 200, the table 300 and the end table 400 coordinate together to provide a double bed 600 when they are unstacked and arranged as shown. The heights of the unstacked units 100, 200, 300 and 400 are equal, thereby providing a flat surface to the users of the assembled double bed. The double bed 600 is of the standard size, thereby allowing use of standard-size double bed items, such as sheets and covers.

In a first preferred embodiment, each unit is made out of a sturdy foam interior and durable leather exterior to provide longevity and enhanced usability. Using high-density foam allows the table units to provide a strong, stable, substantially flat surface upon which articles may rest, such as a glass, dish, vase or other article commonly set to rest on table tops. In a second preferred embodiment, each unit's outer design is provided with custom colors and fabrics. Alternatively, the underside of each top half of each unit and the topside of each bottom half of each unit may be made from a different material than the rest of the covering, such as canvas or other suitable material, so as to provide greater friction between the two halves when they are stacked, thereby increasing the stability between the halves to prevent them from slipping sideways.

The construction and dimensions of the system units are such that they provide an efficient way to save as well as utilize space. Together they provide a construction that provides a comfortable sleeping unit, as well as living units that are comfortable for seating and sturdy enough to function as tables.

FIG. 4A shows that connecting members 110 and 112 may be added to the sides of the units to increase horizontal stability. In FIG. 4A, only unit 100 is shown with the connecting members in place, however, each unit 200, 300 and 400 may be similarly equipped. The members 110 and 112 may be provided on all four sides of the unit 100, or on a fewer number of sides. In FIG. 4B, two sides of unit 100 are shown with connecting members may be of any type suitable for closures, such as velcro, snaps, belts or buttons.

In FIG. 4A, the male portion of a snap is attached to unit half 101 and the female portion of the snap is incorporated into a belt portion attached to unit half 102. FIG. 4B shows an alternative arrangement wherein the connection between the two halves 101, 102 of the unit 100 is effected by the use of a strip or flap 105 (made of cloth, leather or the like) that is integrally formed (for example, by sewing between the lower edge 106 of half 101 and the upper edge 107 of half 102) with one side of each half unit such that half 101 may be folded on top of or away from half 102 instead of being stacked and unstacked. The other units 200, 300 and 400 may be similarly equipped.

Figure 5:
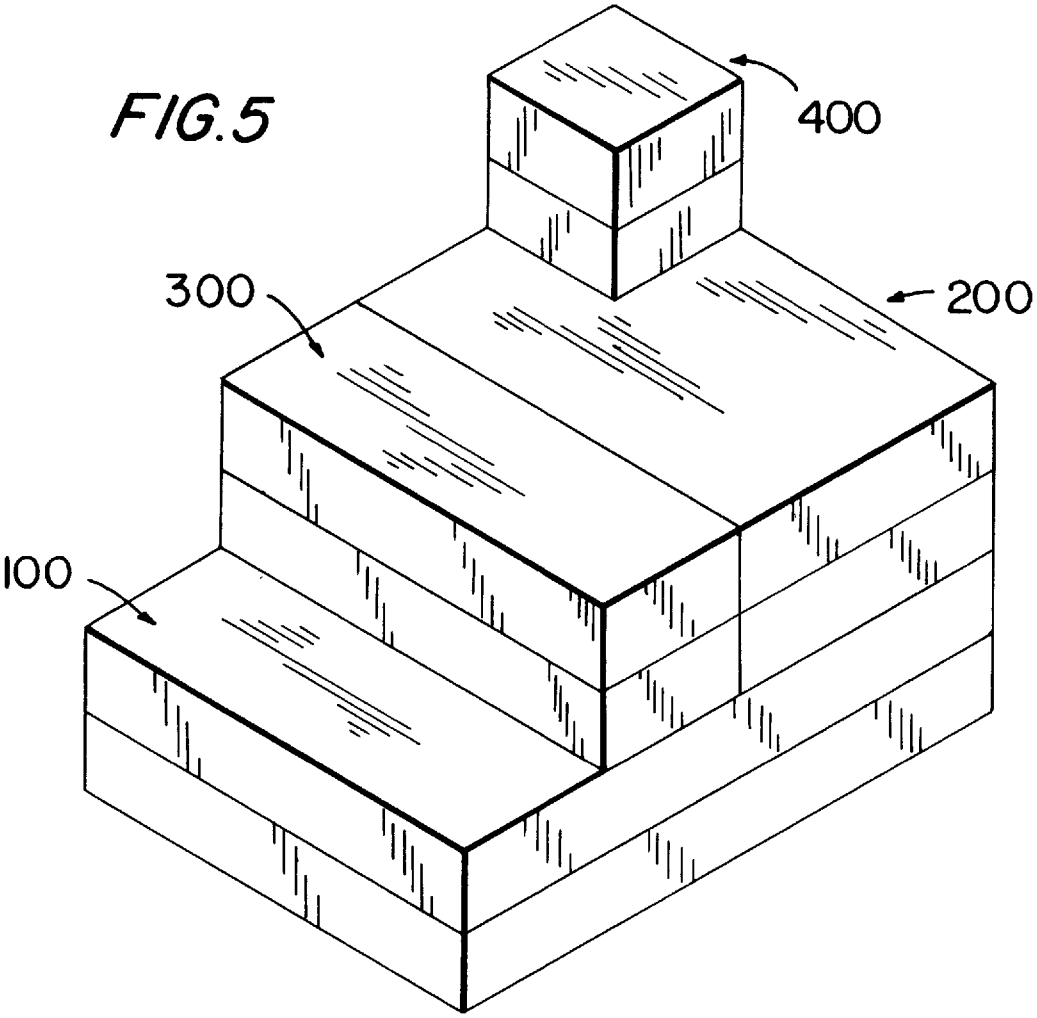
FIG. 5 illustrates a set of basic living system units stacked to save space when none is being used.

FIG. 5 illustrates that the couch 100, the chair 200, the table 300 and the end table 400 may be stacked together to save space when none of the basic units is used.

Figure 6:
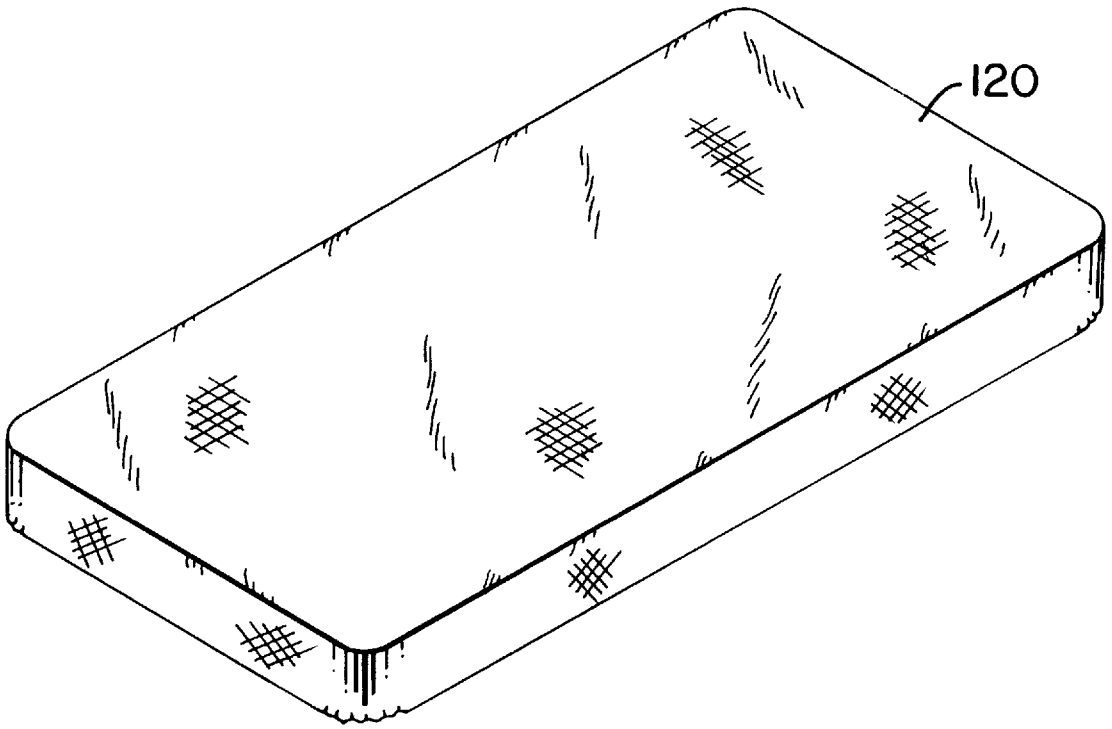
FIG. 6 illustrates a holding cover that may be used with the invention shown in FIG. 3.

FIG. 6 shows a holding cover 120 that can be used with the present invention. The cover 120 is dimensioned to fit over the units 100, 200, 300 and 400 when they are unstacked and arranged in the double bed configuration of FIG. 3. The cover 120 preferably has elastic integrated into the bottom edge of its four corners to enable it to reach under the four corners of the double bed and fit snugly therewith. Alternatively, elastic also may be provided along the entire bottom edge of the cover 120 to provide greater gripping ability. When fit over the double bed of FIG. 3, the cover 120 acts to hold the unstacked individual units together and prevent them from separating during use. Although not shown in the drawings, a similar cover may be dimensioned to fit the single-bed configuration shown in FIG. 2.

The detailed description of the preferred embodiment having been set forth herein, it will be appreciated by those of ordinary skill in the art that there may be departures therefrom without departing from the true spirit and scope of the invention thus disclosed.

I claim:

1. A set of integrated living system units which comprises:

a first unit comprising a first pair of stackable rectangular cushions measuring approximately 39 by 25 inches, said rectangular cushions forming a couch unit for seating when stacked one upon the other, and a second unit comprising a second pair of stackable rectangular cushions measuring approximately 19.5 by 25 inches, said rectangular cushions forming a chair unit for seating when stacked one upon the other, each of said rectangular cushions having an interior and an exterior;

said four rectangular cushions of said first and second units when unstacked being positionable side by side to form a standard-sized single bed such that standard single bed items may be used to cover said bed.

2. The set of living system units of claim 1, wherein the heights of said first unit and said second unit in the unfolded mode are equal.

3. The set of living system units of claim 2, wherein the interior of said first unit and said second unit are made out of sturdy foams.

4. The set of living system units of claim 3, wherein the exterior of said first unit and said second unit are made out of leather.

5. The set of living system units of claim 3, wherein the exterior of said first unit and said second unit are made out of custom colors and fabrics.

6. The set of living system units of claim 4 or 5 further comprising in combination with said living units standard single bed items including bed sheets and covers.

7. A set of integrated living system units which comprises:

a first unit comprising a first pair of stackable rectangular cushions measuring approximately 39 by 25 inches, said rectangular cushions forming a couch unit for seating when stacked one upon the other, a second unit comprising a second pair of stackable rectangular cushions measuring approximately 19.5 by 25 inches, said rectangular cushions forming a chair unit for seating when stacked one upon the other, a third unit comprising a third pair of stackable rectangular cushions measuring approximately 12.5 by 25 inches, said rectangular cushions forming a first table unit when stacked one upon the other and a fourth unit comprising a fourth pair of stackable rectangular cushions measuring approximately 12.5 by 12 inches, said rectangular cushions forming a second table unit when stacked one upon the other, each of said rectangular cushions having and interior and an exterior;

eight rectangular cushions of said first, second, third and fourth units when unstacked being positionable side by side to form a standard-sized double bed such that standard double bed items may be used to cover said bed.

8. The set of living system units of claim 7, wherein the heights of said first unit, said second unit, said third unit and said fourth unit in the unfolded mode are equal.

9. The set of living system units of claim 8, wherein the interior of said first unit, said second unit, said third unit and said fourth unit are made out of sturdy foams.

10. The set of living system units of claim 9, wherein the exterior of said first, second, third and fourth units are made out of leather.

11. The set of living system units of claim 9, wherein the exterior of said first, second, third and fourth units are made out of custom colors and fabrics.

12. The set of living system units of claim 10 or 11 further comprising in combination with said living units standard double bed items including bed sheets and covers.

* * * * *